US005844487A

United States Patent [19]

Britt

[11] Patent Number: 5,844,487

[45] Date of Patent: Dec. 1, 1998

[54] ALERT ALARM RESPONSIVE TO AN UNACCOMPANIED CHILD

[76] Inventor: Paul E. Britt, 5061 College View, Eagle Rock, Calif. 90041

[21] Appl. No.: 915,463

[22] Filed: Aug. 20, 1997

[51] Int. Cl.[6] ..... G08B 13/183; G08B 13/184; G08B 21/00

[52] U.S. Cl. ..... 340/573; 340/522; 340/556

[58] Field of Search ..... 340/556, 557, 340/521, 522, 573

[56] References Cited

U.S. PATENT DOCUMENTS 5,473,310 12/1995 Ko ..... 340/573

5,563,580 10/1996 Stephens ..... 340/573

*Primary Examiner*—Glen Swann

*Attorney, Agent, or Firm*—Donald D. Mon

[57] ABSTRACT

An alert alarm responsive to the passage of a child unaccompanied by an adult. An adult sensor is placed at an adult height higher than any anticipated child. A child sensor is placed at a height lower than the height of the shortest anticipated child. Actuator circuitry is actuated if a child passes the child sensor unless an adult passed the adult sensor within a limited time either before or after the child passed.

7 Claims, 3 Drawing Sheets

ALERT ALARM RESPONSIVE TO AN UNACCOMPANIED CHILD

FIELD OF THE INVENTION

An alarm to alert responsible persons to the passage through a portal of a child unaccompanied by an adult.

BACKGROUND OF THE INVENTION

The security field is replete with examples of alarms which relate to persons who are in an unauthorized area or who pass through a portal without authorization. Depending on the level of security required, these extend from simple entry cards and locks to exclude unauthorized persons, to motion-sensitive monitors and monitoring systems responsive to passive elements carried by all persons which are compared to memory entries to ascertain whether they are properly in the area. These systems have in common the recognition and exclusion or permissive entry of individuals.

There are other systems which monitor the presence of a couple as a couple, or the presence of one member of a couple and the absence of the other member. Such systems are frequently used to be certain that the members of the couple remain in close proximity to one another. These systems are often used in museums and other public places where a child should not be separated from its custodian. These are highly sophisticated systems that utilize passive means carried by members of the couple whose proximity or lack of proximity to one another can be detected and identified by a central monitoring system. The cost of these systems can be justified only for well-to-do institutions, especially those which are sensitive to public liability.

There is a subset of the above requirements that is not fulfilled by existing systems. At least to the knowledge of the applicant herein, this subset has not been recognized. If it were already recognized, the solutions likely to arise from an application of known systems could be expected to result in a system too costly for the intended users of the instant invention to afford. This subset of circumstances exists wherever an adult should be nearby when a child passes through a portal. This means that no child will pass through a portal unnoticed by an adult, but will be recognized as noticed by an adult provided that an adult passes through the portal within a stipulated time window before or after a child passes through.

The simplistic solution is to provide that the portal could be opened only by an adult. This would indeed work, but only when a door or gate is available to be closed and locked, and when such a nuisance is tolerable. It would not function in open halls, or in gates, or in doorways which cannot be locked. Examples are hallways and doorways in nursery schools, and entries to childrens wards in hospitals. Passage of adults must be unimpeded, while children are to be permitted to pass only when accompanied by an adult.

A complication in this objective is that the order of passage through the portal—child first or adult first, must be unimportant. Another is that an alarm that is instantaneous will too often be a false alarm. There must be time for the couple of adult and child to be completed, even if the child is the first to pass. Thus, a suitable system must be tolerant of the very event against which it guards (the passage of a child without an adult) but must then quickly learn whether the event was in fact a violation of its protocol or not.

It is an object of this invention to provide a system which gives an alarm when a child has passed through its portal unless preceded by or followed by an adult within a stipulated period of time. Thus, while a child may pass through a doorway without an accompanying adult, it will be recognized as a problem within a selected period of time which is too short for serious mischief to have occurred, but long enough that if an adult passes through the portal within that time, a false alarm will not be given.

The major problem with false alarms is not so much the immediate event that caused it, but rather the tendency of users to discount real alarms by assuming it is just another false alarm. Too often, the system may instead be turned off as a nuisance.

In order to be acceptable, a system of this type must be useful for portals with heavy traffic loads, and be proof against false alarms. It is an object of this invention to meet the stated requirements, and this with a system which is simple and affordable for small operations where even small capital installations are serious matters.

BRIEF DESCRIPTION OF THE INVENTION

In this invention, discrimination between adults and children is based on the assumption that all children will be shorter than a selected height, and that all adults will be taller than a selected height. An adult sensor is placed at the portal at an upper elevation at or above the adult height, and a child sensor is placed at a lower elevation at or below the child height. All persons will be sensed by the child sensor, but only adults will be sensed by the adult sensor.

An adult timer is triggered by signals from the adult sensor. A child timer is triggered by signals from said child sensor. The time set on the adult timer is the stipulated amount of time to be allowed for a child to pass through the portal after an adult has passed. The time set on the child timer is the amount of time to be allowed for a child to precede an adult through the portal. Should no adult have preceded or followed a child through the portal within these time limits, then an alarm will be sounded.

According to a preferred but optional feature of this invention, the timers are adjustable to provide for selection of the respective amounts of time.

A rare and surprising source of false alarms is the passage of a second adult through the portal at the very moment the adult timer times out after a previous adult has passed. His trailing leg may at that moment be detected as a child while his torso was passed unnoticed by the adult timer, thereby giving a false signal of the passage of a child. As an optional feature of this invention, a coincidence timer respective to the adult sensor with a stipulated amount of time shorter than that of the adult timer will allow the adult enough time to pass through the portal without starting the child timer, so that his trailing leg will not have simulated a child.

According to a preferred but optional feature of the invention, manual override means is provided both to shut off the alarm and to prevent the alarm from sounding when a permissive passage is to be allowed, such as when a student is permitted by a teacher to be in the hallway.

The above and other features of this invention will be fully understood from the following detailed description and the accompanying drawings, in which:

DETAILED DESCRIPTION OF THE INVENTION

Figure 1:
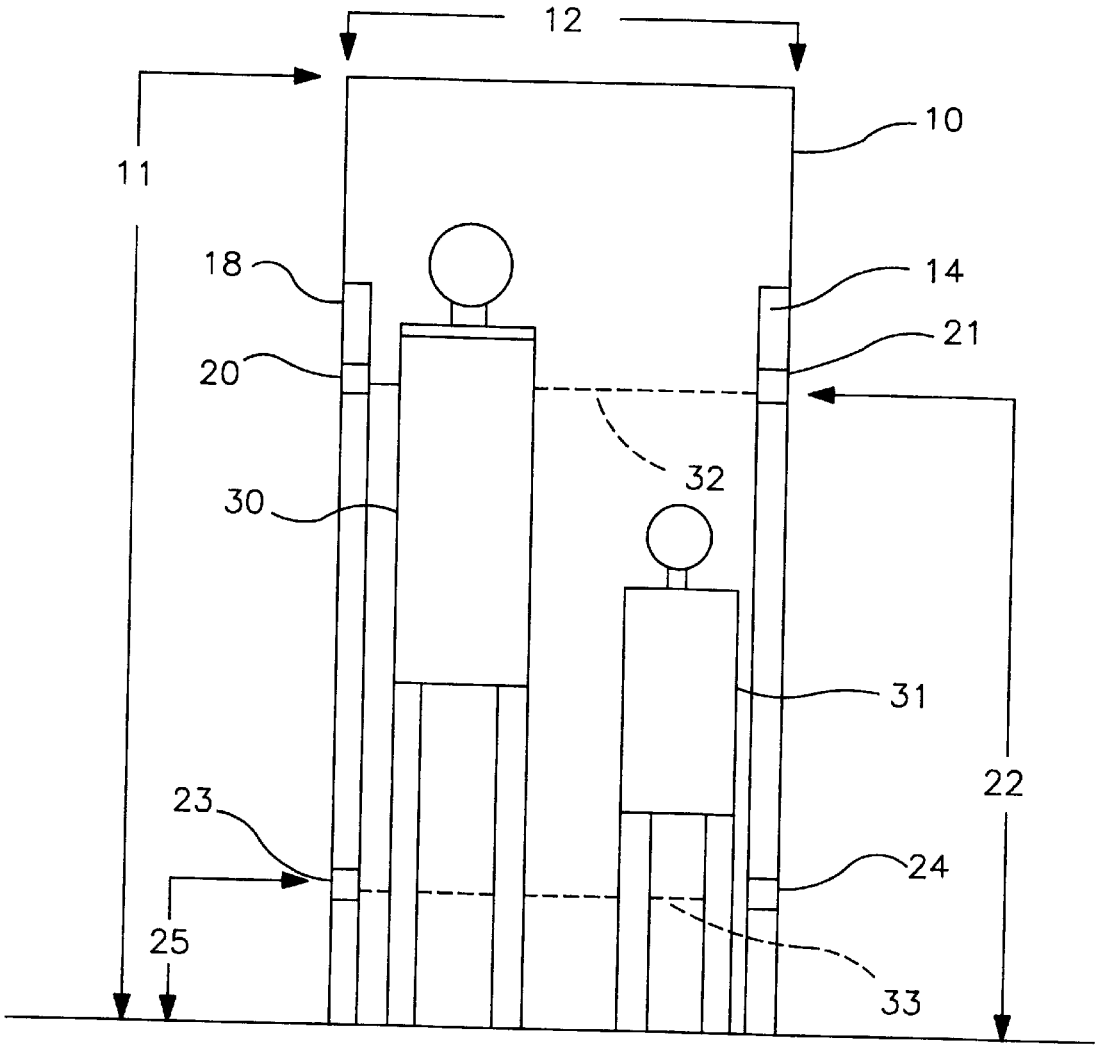
FIG. 1 is an elevation showing an installation of an alarm according to the invention.

FIG. 1 shows a representative portal 10, such as a day care exit doorway, a childrens ward doorway, or a swimming pool gate, for example. The portal will have a dimension 11 of height and a dimension 12 of width. It may or may not be framed. In some installations this alarm may be free standing.

In every installation there will be vertical supports 13, 14 that are spaced apart from each other, and between which all persons passing through the portal must pass.

An adult sensor 20 and an adult emitter 21 are placed at an upper level 22. A child sensor 23 and a child emitter 24 are placed at a lower level 25.

An adult 30 and a child 31 are schematically shown in the portal. The upper level is selected to be at a height where the energy beam 32 between the adult emitter and adult sensor will impinge on all adults, but is above the height of the tallest child anticipated to be encountered and will not impinge on a child. Energy beam 32 is shown impinging on the adult, but not on the child.

The lower level is selected to be at a height where the energy beam 33 between the child emitter and the child sensor will impinge on every child (and obviously also on every adult). The lower level must be below the height of the shortest child anticipated to be encountered. It is shown impinging on both the child and the adult.

In practical installations, the upper level will usually be about 55 inches above the floor, and the lower level will be about 14 inches above the floor. A child requiring surveillance will rarely be more than 55 inches tall, and realistically could not crawl under a 14 inch high beam.

In FIG. 1 both of the emitters are placed on one support 13, and both of the sensors are placed on support 14. While these supports may be free standing with footings, it will usually be more convenient to fasten them to a wall or door frame. It will also be recognized that these supports need not be independent members. Instead the emitters and sensors may simply be attached to building structure, the structure forming the supports.

A simplified mounting may utilize square tubing for the supports. Their flat faces can readily be aligned with one another so the emitters and sensors accurately face each other. Even simpler, both of the emitters and the sensors may be fixed to the same support, and a flat face of the other support may be reflective, for example, one side face of the square tubing. The beam then passes twice across the portal instead of only once. This is a very convenient and simple arrangement.

Figure 2:
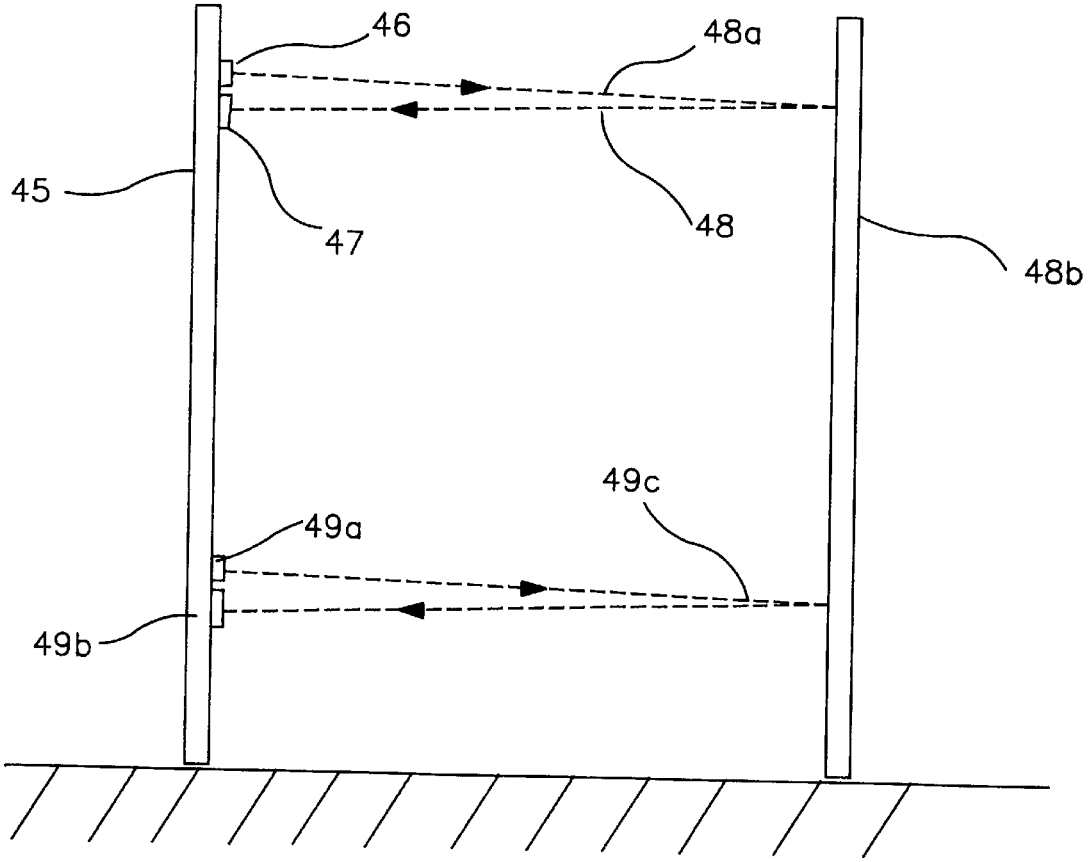
FIG. 2 is a fragmentary elevation showing an alternate installation.

FIG. 2 shows a support 45 bearing both an adult emitter 46 and an adult sensor 47, with the emitted adult beam 48 reflecting from a flat surface 48*a* on an opposite support 49*b* at an upper, adult level. A child emitter 49*a* and a child sensor 49*b* are similarly placed on a support 45. Child beam 49*c* is disposed at a lower child level.

The preferred energy beam is infrared. Any suitable infrared emitter and infrared sensor may be used. These are readily purchased on the open market.

An adult actuator circuit 50 (FIG. 3) includes an adult timer 51. A suitable timer is the TLC 555 sold by Radio Shack, a division of Tandy Corporation, under its catalog number 276-1718. Its threshold and trigger levels are normally two-thirds and one third, respectively, of the input voltage between negative buss 58 and positive buss 62. When its trigger input falls below the trigger level, the flip-flop is set and is output goes high. If the trigger input is above the trigger level and the threshold input is above the threshold level, the flip-flop is reset and the output is low. The reset input can override all other inputs and can be used to initiate a new timing cycle. When the reset input is low, a low impedance path is provided between the discharge terminal and ground.

With the above description of timer function in mind, the connections to the timer will be described schematically. For example, in adult timer 51, the time is established by capacitor 53 and adjustable resistor 54, connected in series between the busses. Lead 55 between them is connected to an appropriate terminals of the timer. Leads 56 and 57 connect the negative buss 58 to appropriate terminals of the timer, there being an optional capacitor 59 in lead 56.

Of particular importance are trigger terminal t and output terminal o. Connecting the negative buss 58 to trigger terminal t will start a timing cycle. During the cycle, the output terminal o will conduct, as will later be described.

Lead 60 provides power to run the timer. Lead 61 provides power for the output terminal while the timer is running, and also provides for resetting the timer when it times out.

This style of timer connections and operation is used in all three of the timers used in this device, and will not be repeated again in detail with respect to the other timers.

The timer is responsive to the open or closed to ground, (non-conducting or conducting) of adult sensor 20. Adult sensor 20, and the child sensor 23, are shown schematically as normally-open switches. Timer 51, once triggered, will continue to pass current from positive buss 62 through output terminal o of the adult timer, and to lead 67, to one side of the coil of adult relay 70 until the timer times out.

The other side of the coil of adult relay 70 is connected to the negative (ground) buss 58 by lead 71. Adult relay 70, while energized, will open its normally closed switch 72. The timer itself is powered through leads 57 and 60.

A normally open manual override switch 75 is placed in parallel with adult sensor 20. Its closure will simulate the passage of an adult through the portal, the same as a closed condition of adult sensor 20, and will therefore trigger the timer.

A child actuator circuit 80, similar in most respects to adult actuator circuit 50, includes a child timer 81, responsive to the open or closed condition (non-conducting or conducting) of child sensor 23. Its closure (conductive condition) will simulate the passage of a child through the portal. It will also recognize the passage of an adult through the portal.

The amount of time child timer 81 will remain conductive is determined by capacitor 82, and adjustable resistor 83. The timer once triggered, will continue to pass current from its output terminal o to lead 84 through leads 84 and 85 to one side of the coil of a double pole, double throw child relay 86 until the timer times out.

The common terminal 87 of first relay switch 88 is serially connected to child sensor 23. It is normally closed so that current resulting from closure of the child sensor will start the child timer which in turn will energize child relay 86 through leads 84 and 85. Energizing child relay 86 will reverse the condition of switch 88 to open, effectively disabling the child sensor, but without stopping the timer. The child timer will continue to supply current to child relay 86 until it times out.

The common terminal 90 of the second relay switch 91 is connected to reset terminal r of child timer 81, and to the common terminal 92 of adult relay switch 72 in adult relay 70. Adult relay Switch 72 is normally closed. It is opened while adult relay 70 is energized.

An alarm 95 such as a buzzer or light is connected to normally open terminal 96 of the second relay switch 91, and to the output terminal o of child timer 81. Alarm 95 has a positive terminal 97 and a negative terminal 98, and will sound or emit light only when these terminals are respectively connected to positive buss 62 and negative buss 58.

A coincidence actuator circuit 100 is optional. It is to be considered an optional part of the adult timer, and is provided to preclude the giving of a false alarm under a specific condition. If this condition is considered to be unimportant, the coincidence timer and its circuitry will simply be omitted.

The coincidence is the event that a signal is received from the child sensor just as the adult timer is about to time out. In this rare but actual situation, the passage of a second adult during the timing sequence after the adult timer has been started will not be recognized when only actuator circuits 50 and 80 are used. So when the upper torso of the second adult will have passed through and beyond the adult beam, and the first adult timer has just timed out, and then his trailing leg passes the child beam, the result will be a child-passed signal which will be followed by an alarm if no other adult passes through the adult beam within the stipulated time. This is a false alarm, which if repeated often can lead to distrust of the system.

To prevent this, coincidence actuator circuit 100 is provided which is also responsive to adult sensor 20. Its coincidence timer 101 has a shorter stipulated time than adult timer 51, so that it does not interfere with the operation of the adult actuator circuit. However, it is responsive to the passage of an adult, and that adult whose torso had just passed through the adult beam is responded to by the coincidence timer (but not by the adult timer which has not quite timed out). The coincidence timer 101 and adult timer 51 do not cancel each other out, so that, even though the adult timer has timed out, the coincidence timer will run, but for a much shorter time. During that shorter time, the adult's trailing leg will have given its false signal, simulating a child. This will complete the coupling of adult and child within a stipulated time, and the system will return to rest, in effect having ignored the false child signal. The system then awaits the next adult signal or child signal.

With this explanation in mind, the details of the coincidence actuator circuit 100 will now be described.

Coincidence timer 101 is connected by lead 111 to adult sensor 20. A signal from the adult sensor will start coincidence timer 101. Capacitor 102 and resistor 103 establish the time period for the coincidence timer, which will be shorter than the time selected for the adult timer and perhaps adjustable although it could be. An adult timer might be set for 15 seconds, and the coincidence timer, perhaps for only 2 seconds, for example, while the child timer might be set for 15 seconds. These relate to the periods of time in which an adult should be near the child, or in which an alarm should be given. The coincidence timer is set for a significantly shorter period, because it relates to a false situation.

Current through leads 104 and 105 keep the timer in operation once it has been triggered. Lead 107 connects the output terminal o of coincidence timer 101 to one side of the coil of adult relay 70, which also receives current from adult timer 51 through lead 67.

Figure 3:
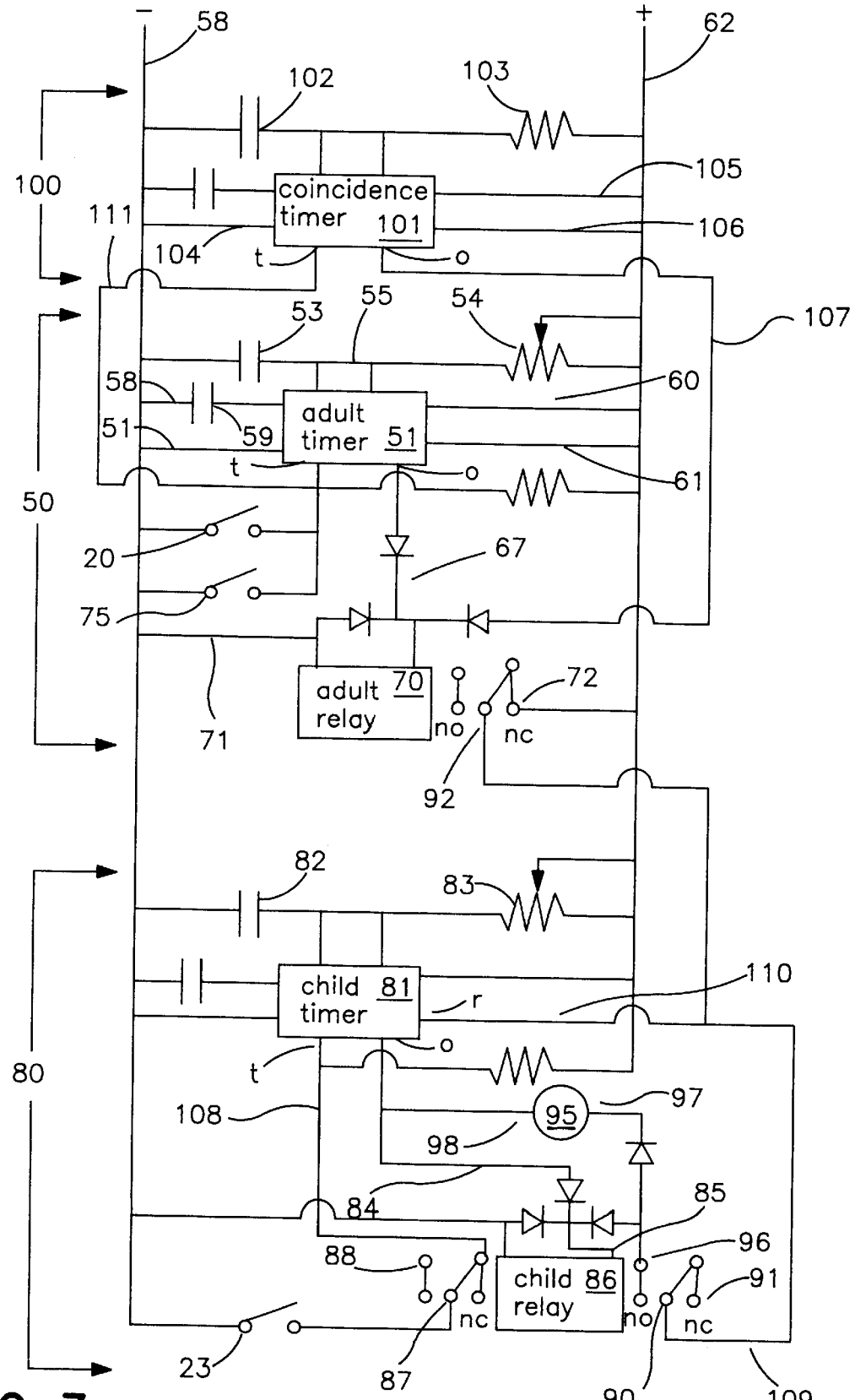
FIG. 3 is a drawing of the presently preferred circuit configuration of the invention.

The system is shown in FIG. 3 in its rest condition, the connections 58 and 62 to the negative and positive poles of a power supply (not shown), for example a 12 volt d.c. power supply. If a child passes through the child energy beam 33, child sensor 23 will close (if mechanical) or conduct (if solid state). Current passes through relay switch 88 and lead 108 to child timer 81. This starts the child timer, which will begin to conduct from the positive buss 62 to its output terminal o. This conductive condition will persist, even after sensor 23 returns to its non-conducting (open) condition for the stipulated period of time set on the child timer.

Child relay 86 is latched in its energized condition, because its other switch, switch 90 receives positive current through lead 109 from common terminal 92 of adult relay switch 72 while the adult timer is not running. Notice that child relay switch 92 is serially connected to adult relay switch 72 of the adult timer. When child relay 86 is energized, its switch 91 will conduct to terminal 96 unless adult relay switch 72 is opened as the consequence of adult relay 70 being energized.

If an adult follows the child through the portal before the child timer times out, then adult relay 70 is energized and switch 72 is opened. The circuit through adult relay 70 is broken. However, if no adult passes through the adult beam while the child timer is in operation, the child timer times out, and the output from its output terminal o goes from positive to negative. Then the alarm 95, which sounds only when current is positive at terminal 97 and negative at terminal 98 will sound or light up. The alarm will not be deactivated by the passage of another child, because the relay switch is latched down.

If adult timer 51 is triggered before the child timer 81, there is no effect on the child timer circuitry. A child passing through the child sensor during the adult timer's time, while starting the child timer, will not sound an alarm, because relay switch 72 in the adult timer circuitry is open.

Lead 110 to reset terminal r of child timer 81 will reset the timer to its non-triggered condition when adult relay switch 72 is opened by activation of the adult timer.

The coincidence circuitry reacts the same as the adult circuitry.

Accordingly, a system watching a portal for unaccompanied children is provided which is simple, inexpensive and rugged.

This invention is not to be limited by the embodiments shown in the drawings and described in the description, which are given by way of example and not of limitation, but only in accordance with the scope of the appended claims.

I claim:

1. An alarm permissive of the passage through a portal of an adult, and of the passage of a child preceded or followed by an adult within preselected lengths of time, and responsive to the passage of a child unless preceded by or followed by an adult dimension of height, a dimension of width, and a pair of spaced apart sides, said alarm comprising:

an adult sensor disposed at an upper height at one side of said portal;

a child sensor disposed at a lower height at one side of said portal;

an energy beam directed across said portal from side to side at each of said heights, directed at the respective one of said sensors whereby each said sensor is responsive to a physical presence in said portal at its respective height;

adult actuator circuitry adapted to be triggered by a signal from said adult sensor respective to a physical presence in the portal at said adult height, said adult actuator circuitry including an adult timer which defines a length of time a child may pass through the portal after an adult has passed without giving an alarm;

child actuator circuitry adapted to be triggered by a signal from said child sensor respective to a physical presence at said child height, said child actuator circuitry including a child timer which defines a length of time within which an adult must pass through the portal after a child has passed without giving an alarm; and alarm circuitry responsive to said actuator circuitry to announce the occasion when said child actuator circuitry has been triggered without a preceding or subsequent triggering of said adult actuator circuitry within lengths of time respective to the first of the actuator circuitry to be triggered.

2. An alarm according to claim 1 in which a manual switch is placed in parallel with said adult sensor to enable a supervisor to simulate the passage of an adult through the portal, thereby to enable an unaccompanied child to pass without sounding an alarm.

3. An alarm according to claim 1 in which said adult actuator circuitry further includes coincidence actuator circuitry which is also triggered by said adult sensor, and which impedes said alarm circuitry at the coincidence of passage of an adult through the portal at the moment when the adult timer times out, under circumstances where the physical orientation of the adult in the portal may be mistaken for the presence of a child.

4. An alarm according to claim 3 in which said coincidence actuator circuitry joins said adult actuator circuitry to simulate the passage of an adult after mistaken response which mistakenly simulates the presence of a child, thereby preventing response by the alarm means.

5. An alarm according to claim 1 in which said adult actuator circuitry includes an adult relay energized by triggering of said adult timer, said child actuator circuitry including a child relay energized by triggering of the child timer, and having a latch switch receiving current from said adult relay while said adult relay is not energized, said alarm circuitry receiving actuating current from said latch switch when said child timer has been actuated and thereafter timed out before an adult has energized the adult circuitry.

6. An alarm according to claim 5 including coincidence actuator circuitry, in which said adult actuator circuitry further includes a coincidence timer which is also triggered by said adult sensor, and which impedes said alarm circuitry at the coincidence of passage of an adult through the portal at the moment when the adult timer times out under circumstances where the physical orientation of the adult in the portal may be mistaken for the presence of a child.

7. An alarm according to claim 6 in which said coincidence timer joins said adult timer to simulate the passage of an adult after a response mistakenly simulating the presence of a child, thereby preventing annunciation by the alarm circuitry.

* * * * *